US010919136B2

(12) United States Patent
Akiba

(10) Patent No.: US 10,919,136 B2
(45) Date of Patent: Feb. 16, 2021

(54) DRIVING TOOL

(71) Applicant: MAKITA CORPORATION, Anjo (JP)

(72) Inventor: Yoshitaka Akiba, Anjo (JP)

(73) Assignee: MAKITA CORPORATION, Anjo (JP)

( * ) Notice: Subject to any disclaimer, the term of this patent is extended or adjusted under 35 U.S.C. 154(b) by 155 days.

(21) Appl. No.: 16/092,244

(22) PCT Filed: Apr. 6, 2017

(86) PCT No.: PCT/JP2017/014427
§ 371 (c)(1),
(2) Date: Oct. 9, 2018

(87) PCT Pub. No.: WO2017/179491
PCT Pub. Date: Oct. 19, 2017

(65) Prior Publication Data

US 2019/0091844 A1 Mar. 28, 2019

(30) Foreign Application Priority Data

Apr. 12, 2016 (JP) ..... 2016-079846

(51) Int. Cl.
*B25C 1/06* (2006.01)
*B25C 1/00* (2006.01)

(52) U.S. Cl.
CPC ..... *B25C 1/06* (2013.01); *B25C 1/008* (2013.01)

(58) Field of Classification Search
CPC ..... B25C 1/06; B25C 1/008
(Continued)

(56) References Cited

U.S. PATENT DOCUMENTS 4,417,681 A 11/1983 Bernecki et al.
4,544,090 A * 10/1985 Warman ..... B25C 1/06 227/131

(Continued)

FOREIGN PATENT DOCUMENTS

JP 2008-229729 A 10/2008
JP 5001751 B2 8/2012
JP 5013911 B2 8/2012

OTHER PUBLICATIONS

Nov. 7, 2019 extended Search Report issued in European Patent Application No. 17782307.7.

(Continued)

*Primary Examiner* — Michelle Lopez
(74) *Attorney, Agent, or Firm* — Oliff PLC

(57) ABSTRACT

A driving tool includes a driver, a first moving mechanism and a second moving mechanism. The driver is held to be linearly movable between an initial position and a driving position along a working axis. The first moving mechanism is configured to move the driver from the initial position to the driving position so as to cause the driver to drive a fastener. The second moving mechanism is configured to return the driver from the driving position to the initial position. The second moving mechanism includes an elastic member configured to generate an elastic force according to torsional moment acting around an axis of the elastic member. The elastic member is configured to return the driver to the initial position by the elastic force generated when the torsional moment acts on the elastic member in interlock with a movement of the driver to the driving position.

16 Claims, 11 Drawing Sheets

(58) Field of Classification Search
USPC ..... 227/8
See application file for complete search history.

(56) References Cited

U.S. PATENT DOCUMENTS 4,721,170 A * 1/1988 Rees ..... B25C 1/06 173/121
5,098,004 A * 3/1992 Kerrigan ..... B25C 5/15 173/121
5,511,715 A * 4/1996 Crutcher ..... B25C 1/06 227/131
5,605,268 A * 2/1997 Hayashi ..... B25C 5/15 227/131
6,705,503 B1 * 3/2004 Pedicini ..... B25C 1/06 173/124
8,167,183 B2 * 5/2012 Matsunaga ..... B25C 1/008 227/117
8,456,901 B2 * 6/2013 DeBrosse ..... G11C 11/16 365/148
10,563,163 B2 * 2/2020 Berry ..... C12M 41/48
2008/0257933 A1 * 10/2008 Takahashi ..... B25C 5/15 227/129
2009/0321495 A1 * 12/2009 Hirabayashi ..... B25C 1/06 227/131
2010/0065294 A1 * 3/2010 Hirabayashi ..... B25C 1/06 173/122
2010/0116863 A1 * 5/2010 Suda ..... B25C 1/008 227/8
2011/0094847 A1 * 4/2011 Hirabayashi ..... B25C 1/06 192/105 R
2013/0233903 A1 9/2013 Brendel et al.

OTHER PUBLICATIONS

Jul. 31, 2019 Office Action issued in Japanese Application No. 2018-511981.
Jun. 20, 2017 International Search Report issued in International Patent Application No. PCT/JP2017/014427.
Oct. 25, 2018 International Preliminary Report on Patentability issued in International Patent Application No. PCT/JP2017/014427.

* cited by examiner

DRIVING TOOL

TECHNICAL FIELD

The present invention relates to a driving tool that is configured to drive a fastener into a workpiece by driving out the fastener.

BACKGROUND ART

A driving tool is known which drives a fastener (material to be driven) such as a nail into a workpiece such as wood. For example, in patent document 1, a driving tool is disclosed which includes a driver, a flywheel and a roller that linearly move the driver from a returned position to an extended position to cause the driver to drive out a fastener, and a return mechanism that returns the driver from the extended position to the returned position. The return mechanism includes rails extending on opposite sides of the driver, and compression coil springs respectively mounted on the rails. The return mechanism is configured to move the driver to the returned position by utilizing an elastic force of the compression coil springs that have been compressed when the driver moves to the extended position.

PRIOR ART DOCUMENT

Patent Document

Patent Document 1: US 2013/0233903 A1

SUMMARY OF THE INVENTION

Problem to be Solved by the Invention

In a mechanism, like the above-described return mechanism, in which a compression coil spring is compressed at high speed, surging may occur and cause collisions between adjacent portions of a coiled wire, which may impair durability of the compression coil spring. Therefore, in order to suppress impairment of durability, the compression coil springs of the above-described return mechanism are formed of multi-stranded twisted wire springs, each of which is formed of several wires twisted together. From the viewpoint of further enhancement of durability of the return mechanism, however, further improvement is desired in the above-described driving tool.

Accordingly, it is an object of the present invention to provide a technique which may contribute to improved durability of a mechanism for returning a driver to an initial position, in a driving tool that drives a fastener into a workpiece by using the driver to drive out the fastener.

Embodiment to Solve the Problem

According to one aspect of the present invention, a driving tool is provided which is configured to drive a fastener. Examples of the fastener may include a nail, a rivet, a pin and a staple. Examples of the driving tool may include a nailer, a tacker and a staple gun. The driving tool includes a driver, a first moving mechanism and a second moving mechanism.

The driver is held to be linearly movable between an initial position and a driving position along a prescribed working axis. The first moving mechanism is configured to move the driver from the initial position to the driving position so as to cause the driver to drive the fastener. The second moving mechanism is configured to return the driver from the driving position to the initial position. The second moving mechanism includes an elastic member which is configured to generate an elastic force according to torsional moment acting around an axis of the elastic member. The elastic member is configured to return the driver to the initial position by the elastic force which is generated when the torsional moment acts on the elastic member in interlock with a movement of the driver to the driving position.

In the driving tool having such a structure, the second moving mechanism can return the driver from the driving position to the initial position by utilizing the elastic force which is generated when torsional moment acts on the elastic member. In such an elastic member, collision between adjacent portions of a coiled wire, which may occur in a compression coil spring, can be prevented. Therefore, the use of the elastic member can improve durability of the second moving mechanism which is configured to return the driver to the initial position after the driver drives the fastener.

Further, as compared with a compression coil spring which expands and contracts in a direction of a central axis of a coil, the elastic member which is configured to generate an elastic force according to torsional moment expands and contracts in its axial direction by a very small amount. Therefore, unlike a case in which the compression coil spring is used, it is not necessary to provide a space margin for expansion and contraction of the spring in the axial direction and to provide a cylindrical guide part, which is often used together with the compression coil spring. Therefore, the second moving mechanism can be reduced in size and weight.

In one aspect of the driving tool according to the present invention, the elastic member may be a torsion coil spring. The torsion coil spring may be formed by spirally winding a wire around a prescribed central axis, and has a fixed end part and an operation end part. The operation end part may be configured to be operated in a direction crossing the central axis of the torsion coil spring. Further, the torsion coil spring may be configured to return the driver to the initial position by the elastic force which is generated when the operation end part is operated in interlock with the movement of the driver to the driving position. In the torsion coil spring which is subjected to torsional moment around the central axis of the coil when the operation end part is operated in the direction crossing the central axis, collision between adjacent portions of a coiled wire can be prevented, so that durability of the second moving mechanism can be improved. Further, it is not necessary to use a special component such as a multi-stranded twisted wire spring as a measure to improve the durability of the spring. Therefore, a cost increase can be suppressed.

In one aspect of the driving tool according to the present invention, the second moving mechanism may further include a spring holding member which is configured to hold the torsion coil spring and to rotate around a rotation axis extending along the central axis of the torsion coil spring. The operation end part of the torsion coil spring may be connected to the spring holding member. The spring holding member may be configured to operate the operation end part when rotated in a prescribed direction around the rotation axis in interlock with the movement of the driver to the driving position. The spring holding member may also be configured to return the driver to the initial position when rotated in an opposite direction which is opposite to the prescribed direction by the elastic force of the torsion coil spring. By thus interlocking the rotation of the spring holding member, which holds the torsion coil spring with the operation end part connected thereto, with the movement of the driver, a function of generating the elastic force in the torsion coil spring by means of the movement of the driver to the driving position and returning the driver to the initial position by the elastic force can be realized with a simple and compact structure.

In one aspect of the driving tool according to the present invention, the second moving mechanism may further include a support member which is configured to support the spring holding member so as to be rotatable relative to a tool body of the driving tool and which is also configured to guide rotation of the spring holding member. The fixed end part of the torsion coil spring may be connected to the support member and thereby fixed to the tool body via the support member. In this case, the support member can realize two functions of guiding the rotation of the spring holding member and fixing the fixed end part of the torsion coil spring to the tool body.

In one aspect of the driving tool according to the present invention, the second moving mechanism may further include a flexible member which connects the driver and the spring holding member. The spring holding member may have a winding part, which has an outer periphery on which the flexible member is to be wound. Further, the flexible member may be configured to rotate the spring holding member in the prescribed direction when drawn out from the winding part by the movement of the driver to the driving position. The flexible member may be also configured to return the driver to the initial position when wound on the winding part by the rotation of the spring holding member in the opposite direction, the rotation being caused by the elastic force of the torsion coil spring. Thus, by connecting the driver and the spring holding member by the flexible member which can be wound on the spring holding member, the movement of the driver and the rotation of the spring holding member can be interlocked with each other with a simple and compact structure.

In one aspect of the driving tool according to the present invention, the flexible member may be arranged in a pair across the working axis. In this case, the driver can be stably moved along the working axis when the pair of flexible members are wound on the spring holding member.

In one aspect of the driving tool according to the present invention, the rotation axis of the spring holding member may be located between a base end and a tip end of the driver when the driver is placed in the initial position. The tip end of the driver is an end which is configured to abut on the fastener, and the base end of the driver is another end on a side opposite to the tip end in an extending direction of the working axis. As for the above-described arrangement, it can also be rephrased that the spring holding member and the driver are arranged to at least partly overlap with each other in the extending direction of the working axis when the driver is placed in the initial position. In this case, the overall length of the driver and the spring holding member connected by the flexible member can be shortened as much as possible in the extending direction of the working axis of the driver.

In one aspect of the driving tool according to the present invention, a length of the outer periphery of the winding part may be set to be longer than a travel of the driver between the initial position and the driving position. The travel of the driver between the initial position and the driving position corresponds to a length of the flexible member which is to be wound on the winding part. Therefore, when the length of the outer periphery of the winding part is longer than the travel of the driver, the flexible member can be wound on the winding part without overlapping, so that deterioration of the flexible member due to friction can be suppressed.

DESCRIPTION OF EMBODIMENT

An embodiment of the present invention is now described with reference to the drawings. In the embodiment, an electric nailer 1 is described as an example of a driving tool. The nailer 1 is a tool that is capable of performing a nail-driving operation of driving a nail 9 into a workpiece 100 (such as wood) by linearly driving out the nail 9.

Figure 1:
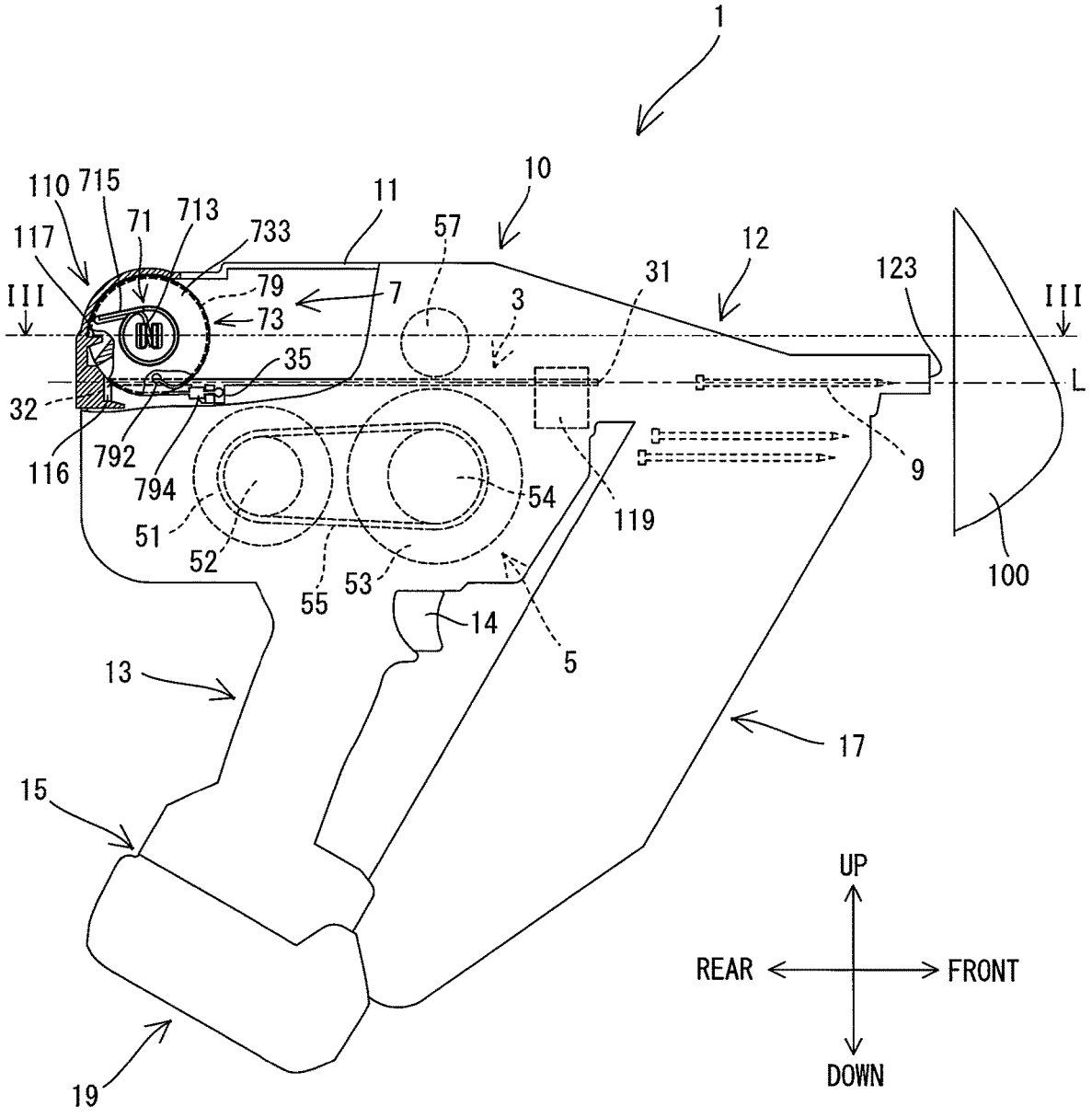
FIG. 1 is an explanatory drawing for illustrating an overall structure of a nailer when a driver is placed in an initial position.

First, a general structure of the nailer 1 is described with reference to FIG. 1. As shown in FIG. 1, the nailer 1 mainly includes a body 10, a nose part 12, a handle 13 and a magazine 17.

The body 10 includes a housing 11, a driver 3, a driving-out mechanism 5 and a return mechanism 7. The housing 11 forms an outer shell of the body 10 and houses the driver 3, the driving-out mechanism 5 and the return mechanism 7. The driver 3 is configured to drive out the nail 9 from the nailer 1 by linearly moving along a prescribed working axis L. The driving-out mechanism 5 is a mechanism that is configured to move the driver 3 in a direction of driving out the nail 9. The return mechanism 7 is a mechanism that is configured to return the driver 3 to an initial position after the driver 3 drives out the nail 9. The driver 3, the driving-out mechanism 5 and the return mechanism 7 will be detailed later. The nose part 12 is connected to one end of the housing 11 in an extending direction of the working axis L (hereinafter simply referred to as a working-axis-L direction) and has a driver passage (not shown) which extends through the nose part 12 in the working-axis-L direction. One end of the driver passage is open to the inside of the housing 11 and the other end is open to the outside of the nailer 1, as an injection port 123 through which the nail 9 may be driven out.

The handle 13 extends in a direction crossing the working axis L from a central portion of the housing 11 in the working-axis-L direction. The handle 13 is a portion that is configured to be held by a user. A trigger 14, which is configured to be operated by a user, is provided on a base end portion (an end portion which is connected to the housing 11) of the handle 13. Further, a battery 19 is removably mounted to a distal end portion (the other end portion on the side opposite to the base end portion) of the handle 13 via a battery mounting part 15 having terminals. Although not shown, a controller for controlling the driving-out mechanism 5 is disposed within the handle 13. The magazine 17 is configured to be loaded with a plurality of nails 9 and mounted to the nose part 12. The nails 9 loaded in the magazine 17 may be fed one by one to the driver passage by a nail feeding mechanism (not shown).

In the following description, for convenience sake, the working-axis-L direction of the driver 3 (the left-right direction of FIG. 1) is defined as a front-rear direction of the nailer 1. The injection port 123 side (the right side of FIG. 1) is defined as a front side of the nailer 1 and its opposite side (the left side of FIG. 1) is defined as a rear side. Further, a direction (the top-bottom direction of FIG. 1) that is perpendicular to the working-axis-L direction and that corresponds to an extending direction of the handle 13 is defined as an up-down direction of the nailer 1. The side of the handle 13 (the upper side of FIG. 1) which is connected to the body 10 (the housing 11) is defined as an upper side, and the other side having the distal end portion of the handle 13 (to which the battery 19 may be mounted) is defined as a lower side.

Next, the structures of the driver 3, the driving-out mechanism 5 and the return mechanism 7 will be described in detail below in this order, with reference to FIGS. 1 to 11.

The driver 3 is now described with reference to FIGS. 1 to 5. As shown in FIG. 1, the driver 3 is formed as an elongate member. The driver 3 is disposed such that its longitudinal axis coincides with the working axis L and extends in the front-rear direction of the nailer 1. In the present embodiment, the driver 3 is symmetrically formed in the left-right direction with respect to the longitudinal axis (the working axis L). Therefore, the center of gravity of the driver is located on the longitudinal axis. By thus setting the center of gravity of the driver 3 on the working axis L, the driver 3 can be stably moved along the working axis L.

Figure 2:
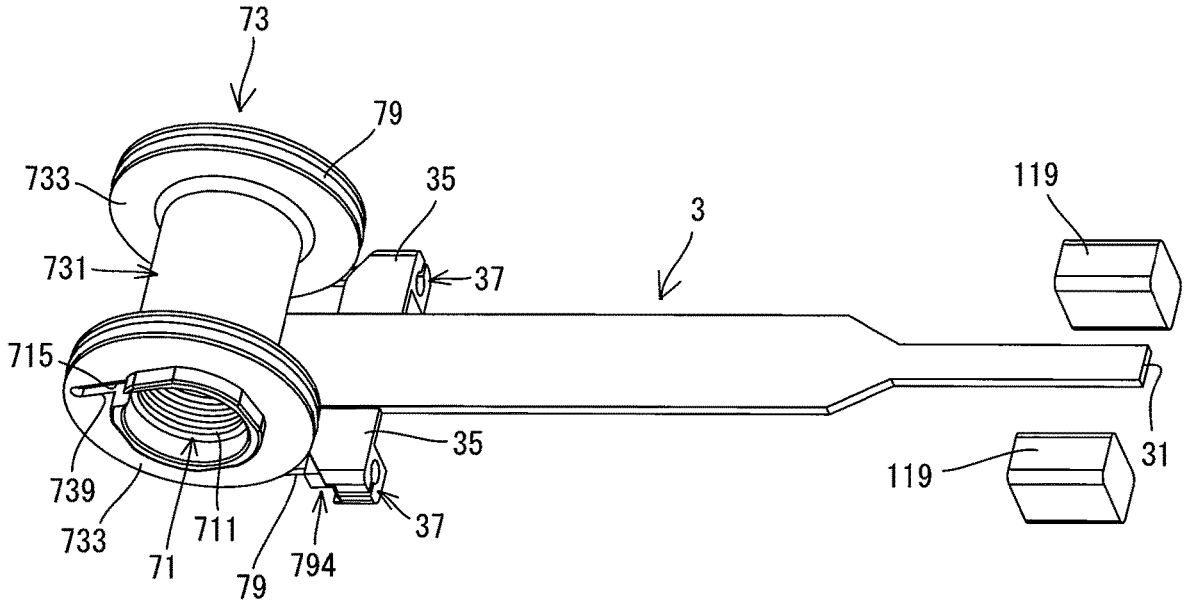
FIG. 2 is a perspective view showing a return mechanism when the driver is placed in the initial position.
Figure 3:
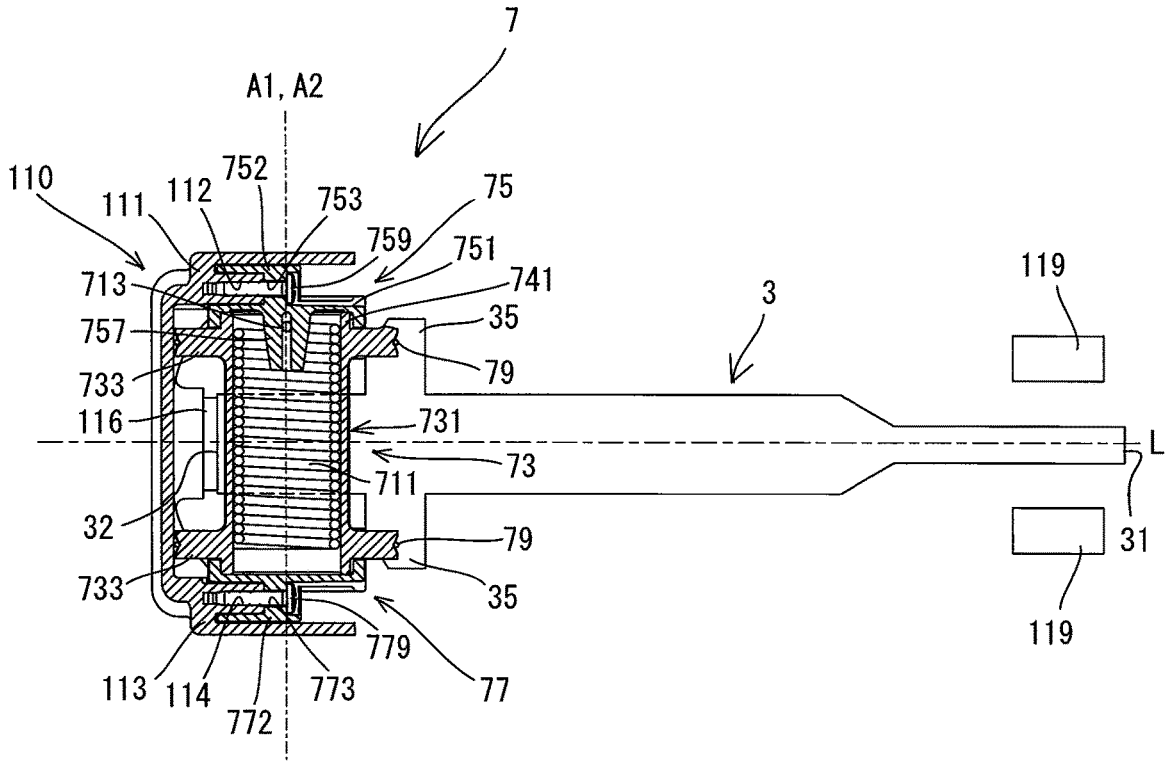
FIG. 3 is a sectional view taken along line III-III in FIG. 1 and showing the return mechanism and a return mechanism housing part when the driver is placed in the initial position (wherein a locking part and a rotation stopper are not shown).

A front end 31 of the driver 3 is a portion that serves as a striking part for striking the nail 9. A rear end 32 of the driver 3 is a portion that defines an initial position of the driver 3 by abutting on a rear stopper 116 to be described later. As shown in FIGS. 2 and 3, a pair of locking arms 35 protrude from the driver 3 to the right and left, between a central portion of the driver 3 in the front-rear direction and the rear end 32. The locking arms 35 are portions that are configured to restrict a frontward movement of the driver 3 by abutting on front stoppers 119 to be described later. Further, the locking arm 35 has a wire connection part 37 with which a locking end part 794 of a wire 79 (described later) is engaged.

The driver 3 is held to be linearly movable between the initial position and a driving position along the working axis L (in other words, in the front-rear direction of the nailer 1 or in the longitudinal axis direction of the driver 3). More specifically, in the present embodiment, the driver 3 is held by a flywheel 53 and the return mechanism 7 (which will be described later) so as to be linearly movable between the initial position and the driving position along the working axis L.

Figure 4:
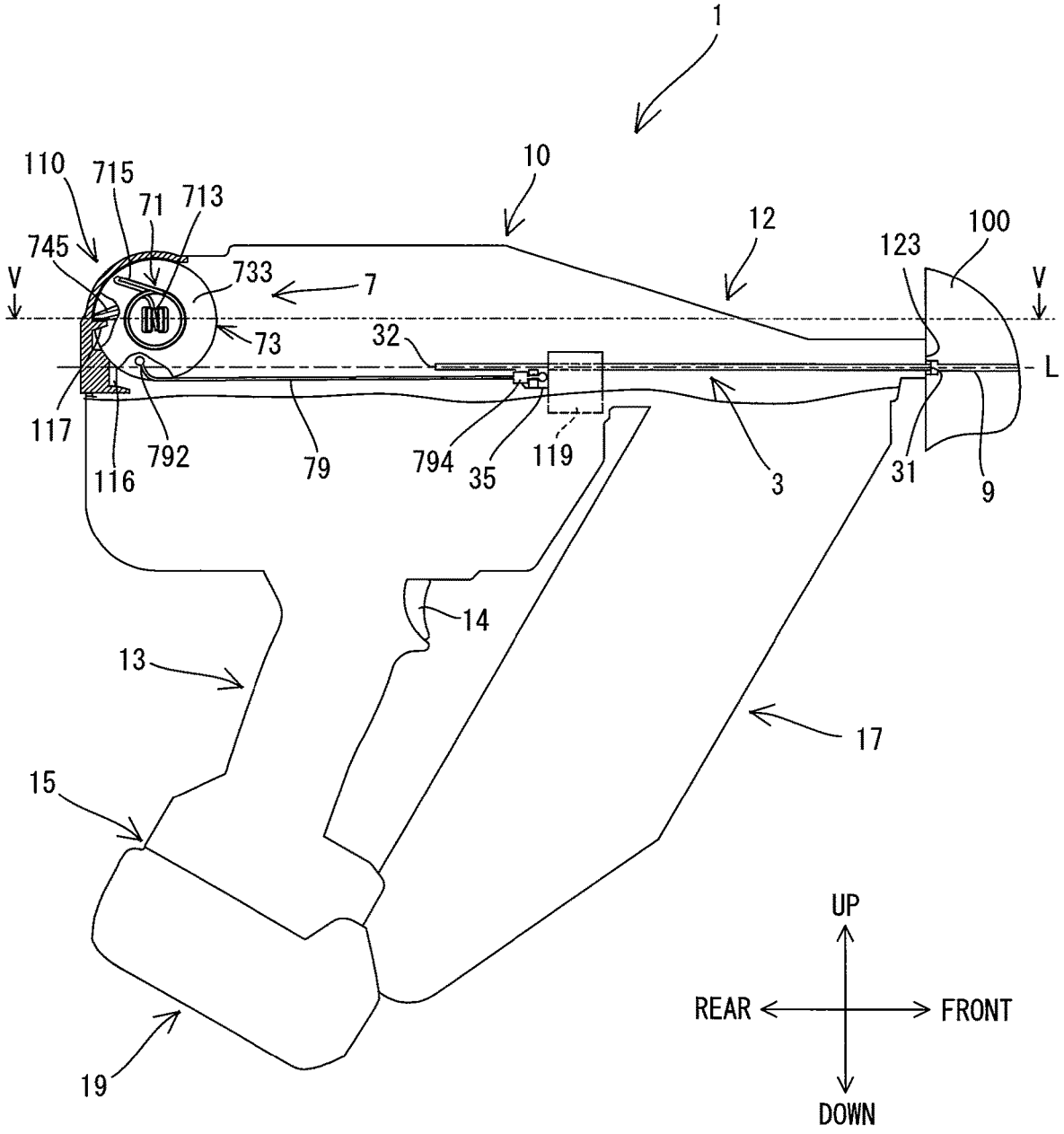
FIG. 4 is an explanatory drawing for illustrating the overall structure of the nailer when the driver is placed in a driving position.
Figure 5:
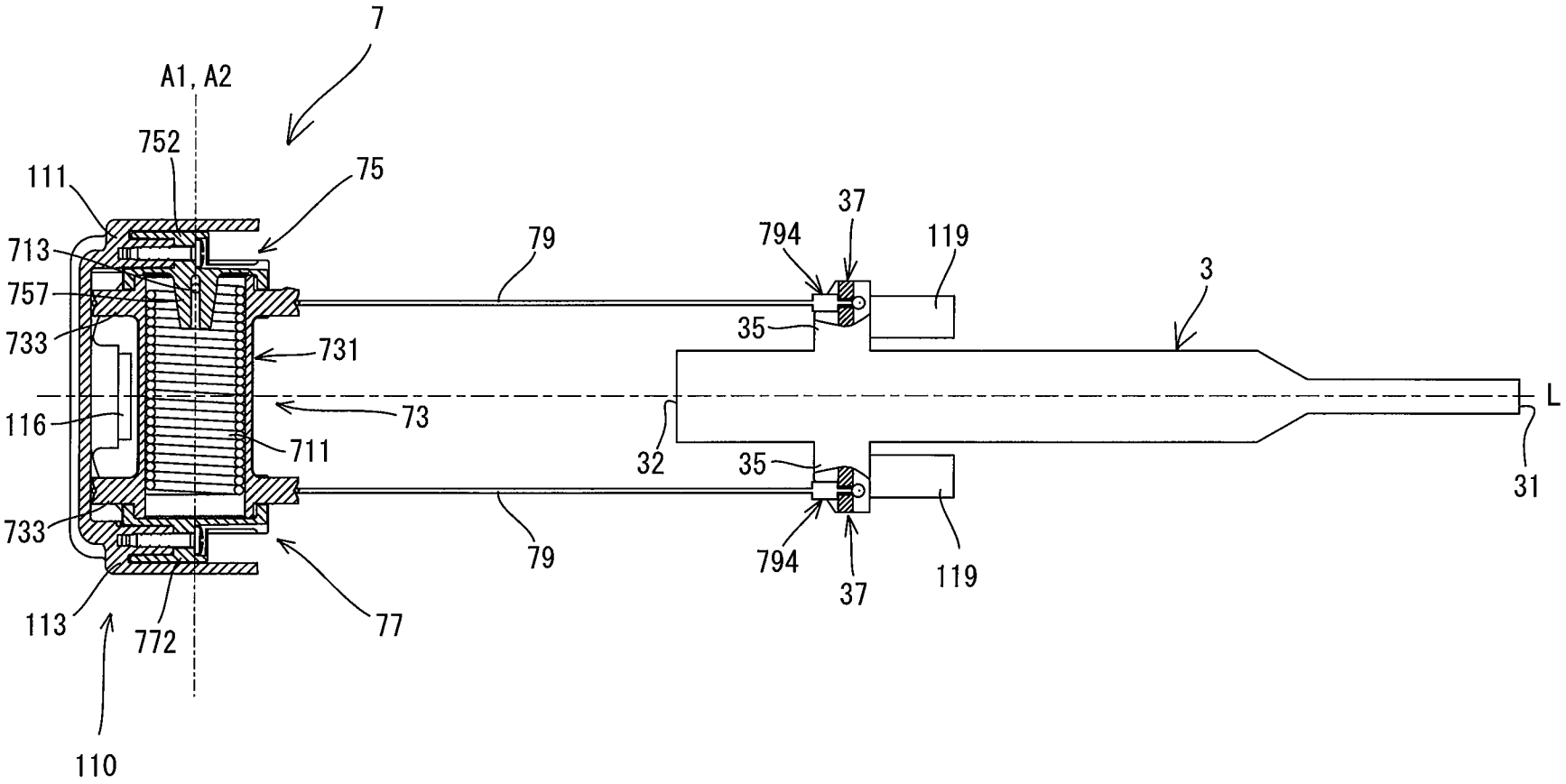
FIG. 5 is a sectional view taken along line V-V in FIG. 4 and showing the return mechanism and the return mechanism housing part when the driver is placed in the driving position (wherein the locking part and the rotation stopper are not shown).

The initial position and the driving position of the driver 3 are now described. The initial position is a position in which the driver 3 is held when the driving-out mechanism 5 is not actuated. In the present embodiment, as shown in FIGS. 1 and 3, the initial position of the driver 3 is set to a position in which the rear end 32 of the driver 3 abuts on the rear stopper 116 provided on an inner surface of a rear end portion of the housing 11. The driving position is a position in which the driver 3 which has been moved forward by the driving-out mechanism 5 drives the nail 9 into a workpiece. In the present embodiment, as shown in FIG. 4, the driving position of the driver 3 is set to a position in which the front end 31 of the driver 3 slightly protrudes from the injection port 123. It is noted that, as shown in FIGS. 4 and 5, the driving position of the driver 3 is a position in which front ends of the locking arms 35 of the driver 3 abut from the rear onto the front stoppers 119 fixed to the inside of the front end portion of the housing 11. From the viewpoint of the above-described arrangement, in the present embodiment, it can also be said that the initial position and the driving position define both ends of a travel range of the driver 3 which moves along the working axis L. It is noted that, in the present embodiment, the front stoppers 119 are formed of a cushioning material to reduce the impact of collision of the driver 3.

The driving-out mechanism 5 is now described with reference to FIG. 1. As shown in FIG. 1, the driving-out mechanism 5 includes a motor 51, a flywheel 53 and a pressure roller 57.

The motor 51 is provided as a driving source and disposed such that its output shaft extends in a left-right direction of the nailer 1 (in a direction perpendicular to the paper face of FIG. 1). A pulley 52 is connected to the output shaft of the motor 51.

The flywheel 53 is configured to be rotationally driven by the motor 51. The flywheel 53 is rotatably supported in front of the motor 51 such that its rotation shaft extends in parallel to the output shaft of the motor 51 (that is, in the left-right direction). A pulley 54 is connected to the rotation shaft of the flywheel 53. A belt 55 is looped over the pulleys 52 and 54. When the motor 51 is driven, rotation of the motor 51 is transmitted to the flywheel 53 via the belt 55, which causes the flywheel 53 to rotate clockwise as viewed in FIG. 1. Further, in the present embodiment, although not shown in detail, a contact arm which can move back and forth in the front-rear direction is provided on a front end portion of the nose part 12. When the contact arm is pressed against the workpiece 100 and a switch connected to the contact arm is turned on, the motor 51 is driven and the flywheel 53 is rotated.

The pressure roller 57 is configured to move the driver 3 in cooperation with the flywheel 53. The pressure roller 57 is rotatably supported above the flywheel 53 such that its rotation axis extends in parallel to the rotation axis of the flywheel 53 (in the left-right direction). Further, in the present embodiment, although not shown in detail, the pressure roller 57 is configured to be movable in the up-down direction between a pressing position, in which the pressure roller 57 abuts on the driver 3 from above and presses the driver 3 against the flywheel 53, and a separate position, in which the pressure roller 57 is separated from the driver 3. More specifically, the pressure roller 57 is normally held in the separate position, but when the motor 51 is driven, the trigger 14 is pulled and the switch connected to the trigger 14 is turned on, the pressure roller 57 is moved from the separate position to the pressing position. If the flywheel 53 is rotated clockwise as viewed in FIG. 1 at this time, the driver 3 held between the flywheel 53 and the pressure roller 57 is moved to the driving position against an elastic force of a return spring 71 to be described later, striking the nail 9 to drive out the nail 9 from the injection port 123.

Now, prior to explanation of the return mechanism 7, a return mechanism housing part 110 in which the return mechanism 7 is disposed is described with reference to FIGS. 1 and 3. As shown in FIG. 1, the return mechanism housing part 110 is provided in an upper rear end portion of the housing 11. The return mechanism housing part 110 includes a first fixing part 111, a second fixing part 113, the rear stopper 116 and a rotation stopper 117.

As shown in FIG. 3, the first fixing part 111 is formed in an upper left portion of the rear end portion of the housing 111. The second fixing part 113 is formed in an upper right portion of the rear end portion of the housing 111. The first and second fixing parts 111, 113 are portions to which first and second support members 75, 77 to be described later are respectively fixed. The first and second fixing parts 111, 113 are symmetrically formed. The first and second fixing parts 111, 113 are respectively engageable with the first and second support members 75, 77 (specifically, body fixing parts 752, 772) and have threaded holes 112, 114 into which screws 59, 779 may be threadably engaged.

As shown in FIGS. 1 and 3, the rear stopper 116 is a portion that is configured to abut on the rear end 32 of the driver 3 when the driver 3 is placed in the initial position and to restrict a further rearward movement of the driver 3 from the initial position. It can also be said that the rear stopper 116 is a portion that defines the initial position of the driver 3. In the present embodiment, a region of the rear end portion of the housing 11 which is located behind the driver 3 is formed to protrude forward, and the rear stopper 116 is disposed on a front surface of this protruding region. In the present embodiment, the rear stopper 116 is formed of a cushioning material to reduce the impact of collision of the driver 3.

As shown in FIG. 4, the rotation stopper 117 is a portion that is configured to abut on a locking part 745 of a spring holding drum 73 to be described later when the driver 3 is placed in the driving position. The rotation stopper 117 is configured to restrict rotation of the spring holding drum 73 in a direction in which the wire 79 is drawn out (hereinafter referred to as a drawing-out direction). In the present embodiment, the rotation stopper 117 is configured as a projection protruding forward from the rear end portion of the housing 11. Two such rotation stoppers 117 are provided, corresponding to a pair of locking parts 745 of the spring holding drum 73, behind the locking parts 745.

The return mechanism 7 is now described with reference to FIGS. 1 to 3 and FIGS. 6 to 11. The return mechanism 7 includes a return spring 71, the spring holding drum 73, the wires 79, the first support member 75 and the second support member 77.

The return spring 71 is a torsion coil spring formed by spirally winding a metal wire around a prescribed central axis A1. The torsion coil spring is a coil spring which is subjected to torsional moment around the central axis A1 of a coil, and bending stress may be generated in the wire when load is applied to the spring.

Figure 6:
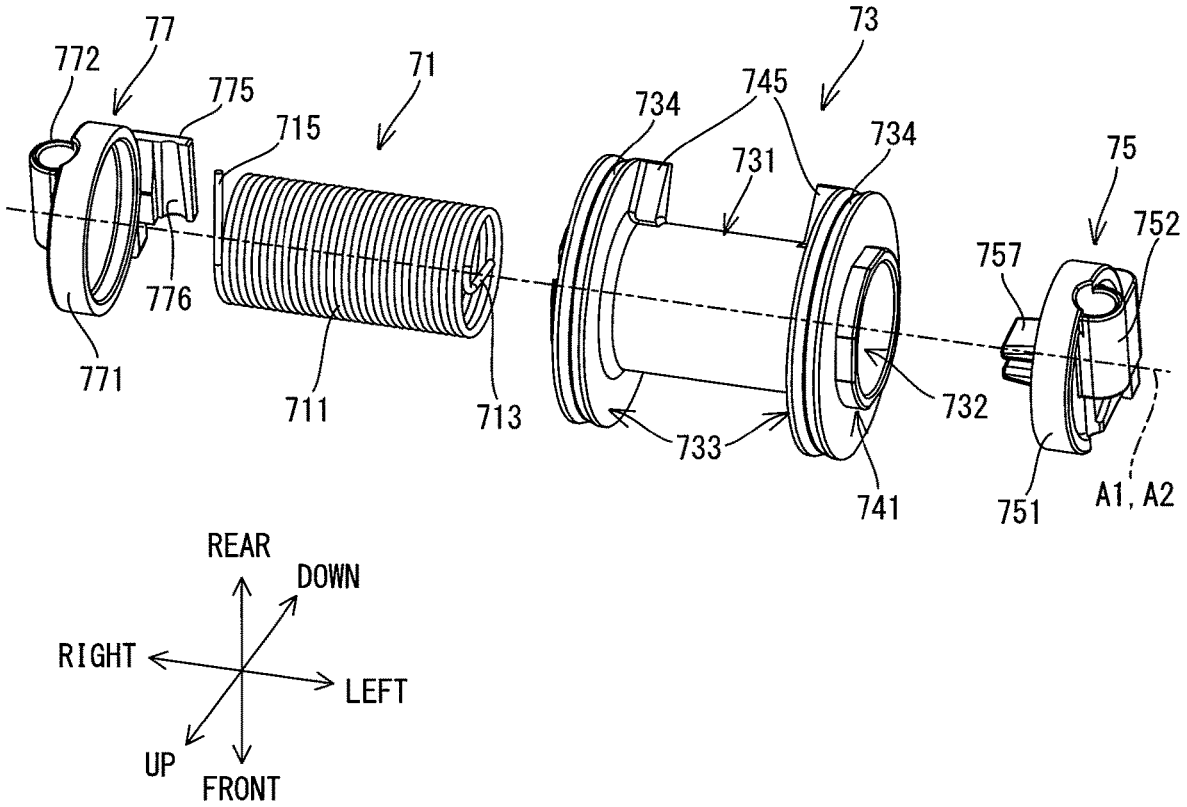
FIG. 6 is an exploded perspective view of the return mechanism (wherein wires are not shown).

As shown in FIG. 6, the return spring 71 includes a coil part 711, a fixed end part 713 and an operation end part 715. The coil part 711 is a portion that forms a coil of the return coil spring 71. The fixed end part 713 is one end portion of the wire forming the return spring 71 and is fixed to the housing 11 via the first support member 75 to be described later. In the present embodiment, the fixed end part 713 extends from one end (more specifically, a left end) of the coil part 711, corresponding to a diameter of the coil part 711. The operation end part 715 is the other end portion of the wire forming the return spring 71 and is configured to be operated in a direction crossing the central axis A1 in interlock with the movement of the driver 3. In the present embodiment, the operation end part 715 extends from the other end (more specifically, right end) of the coil part 711 in a tangential direction of the coil part 711. In the present embodiment, the operation end part 715 is configured to be operated in a direction of winding the coil (in a counter-clockwise direction in FIG. 1, hereinafter simply referred to as a winding direction) in interlock with a forward movement of the driver 3, which will be described in more detail later.

The spring holding drum 73 is configured to hold the return spring 71 and to rotate around a rotation axis A2 extending along (on) the central axis A1 of the return spring 71. As shown in FIG. 6, in the present embodiment, the spring holding drum 73 includes a body 731 and winding parts 733.

Figure 7:
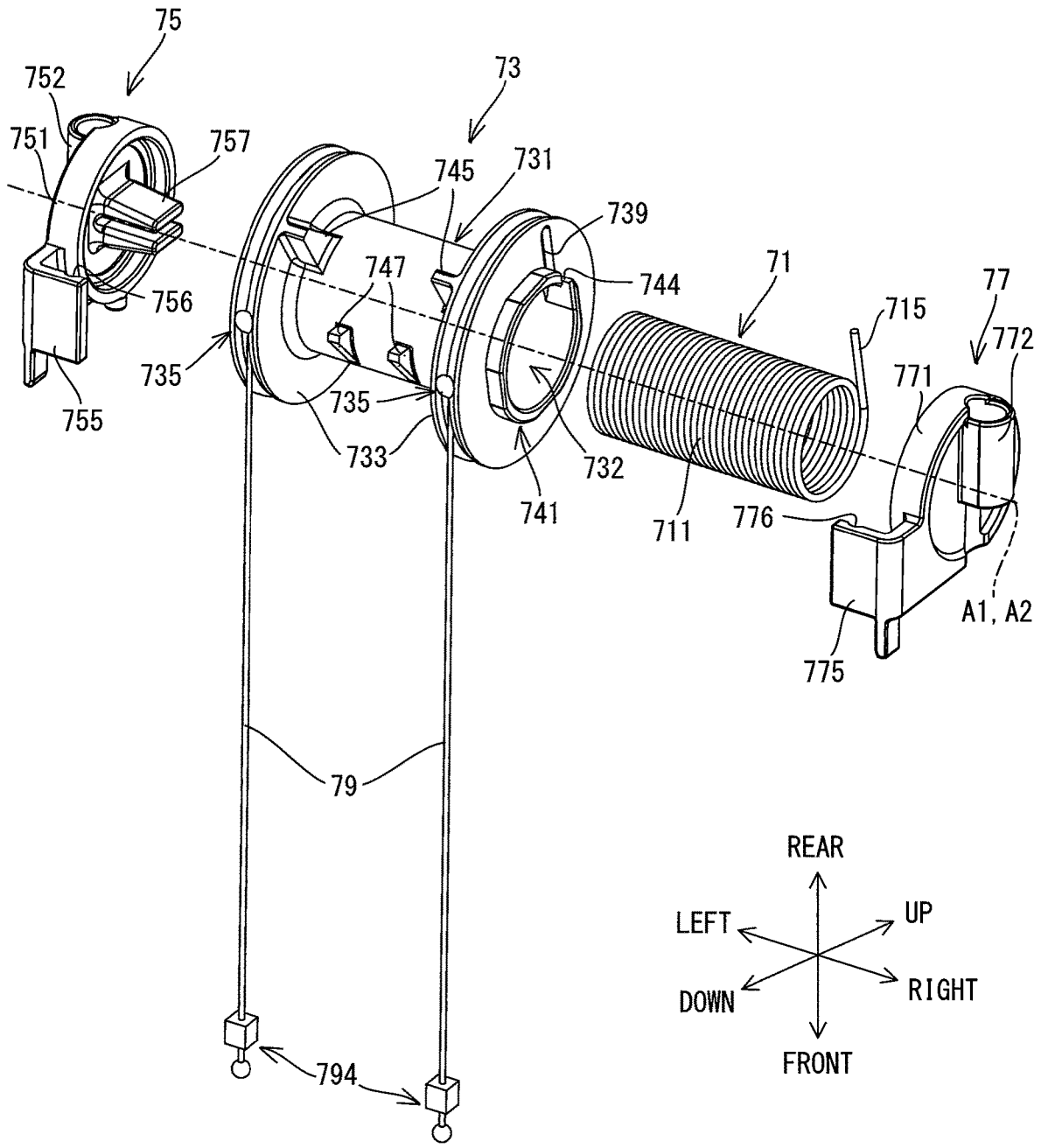
FIG. 7 is another exploded perspective view of the return mechanism.
Figure 8:
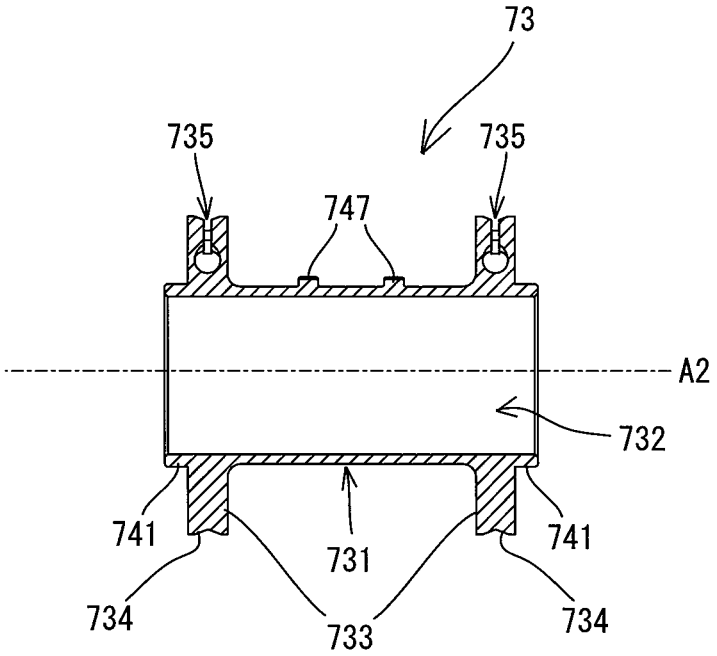
FIG. 8 is a longitudinal sectional view of a spring holding drum.
Figure 9:
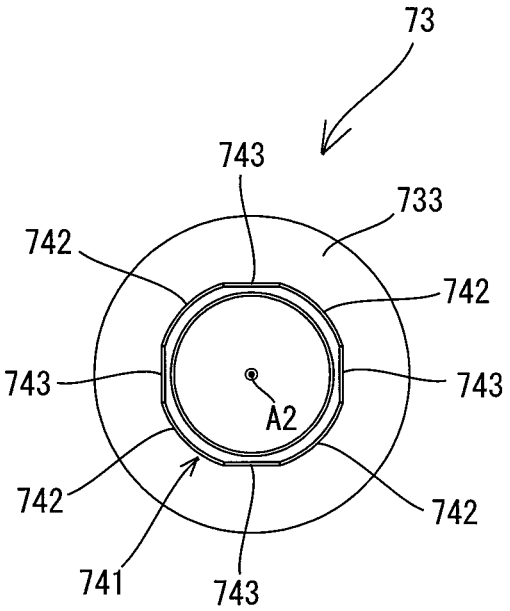
FIG. 9 is a side view of the spring holding drum.
Figure 10:
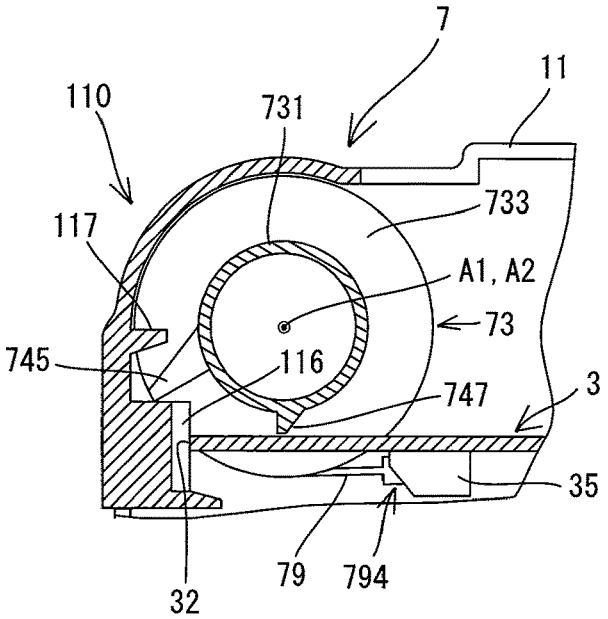
FIG. 10 is a sectional view showing a positional relationship between a driver guide part and the driver when the driver is placed in the initial position.

As shown in FIG. 8, the body 731 is a circular cylindrical portion extending in a direction of the rotation axis A2. The internal space of the body 731 is configured as a coil housing space 732 for housing the coil part 711 of the return spring 711. Both end portions of the body 731 in the rotation axis A2 direction are formed as rotation guide parts 741. The rotation guide parts 741 are configured to be respectively supported by rotation support parts 751, 771 of the first and second support members 75, 77 (which will be described later), and to guide rotation of the spring holding drum 73. As shown in FIG. 9, an outer circumferential surface of the rotation guide part 741 includes a curved surface part 742 having a circular arc section perpendicular to the rotation axis A2, and a flat surface part 743 having a straight section perpendicular to the rotation axis A2. In the present embodiment, four such curved surface parts 742 and four such flat surface parts 743 are alternately arranged in a circumferential direction of the rotation guide part 741. The curved surface parts 742 are configured as sliding surfaces which slide in contact with an inner circumferential surface of the rotation support part 751 or 771, while the flat surface parts 743 are configured to be spaced apart from the inner circumferential surface of the rotation support part 751 or 771. Further, as shown in FIG. 7, one of the rotation guide parts 741 (more specifically, the right rotation guide part 741) has a cut part 744 formed by partially cutting its outer periphery.

As shown in FIGS. 6 to 8, the winding parts 733 are a pair of flange-like parts protruding radially outward from the body 731 and provided adjacent to the rotation guide parts 741 formed on the both ends of the body 731. Each of the winding parts 733 is configured such that the wire 79 can be wound on its outer periphery. More specifically, a winding groove 734 is formed throughout the outer periphery of the winding part 733 in a circumferential direction of the rotation axis A2. The length of the outer periphery of the winding part 733 (that is, the length of the winding groove 734) is set to be slightly longer than a travel of the driver 3 between the initial position and the driving position. A wire connection part 735, to which a locking end part 792 (described later) of the wire 79 is locked, is formed in the winding groove 734. Further, a locking groove 739 is formed in an outer face (right face) of one of the two winding parts 733 (more specifically, the right winding part 733). The locking groove 739 extends radially outward from a radially inner end of the outer face. A radially inner end of the locking groove 739 is formed at a position corresponding to the cut part 744 of the rotation guide part 741. The operation end part 715, which protrudes from the coil part 711 housed in the coil housing space 732 in the tangential direction of the coil part 711, is fitted in the locking groove 739.

In the present embodiment, as shown in FIG. 7, the locking parts 745 and driver guide parts 747 are provided on the body 731. A pair of the locking part 745 and a pair of the driver guide parts 747 are formed as protrusions protruding radially outward from the outer circumferential surface of the body 731.

Each of the locking parts 745 is formed contiguously to an inner face of the winding part 733 in the rotation axis A2 direction. The amount of protrusion of the locking part 745 is equal to that of the winding part 733. The locking part 745 is a portion that is configured to engage with the rotation stopper 117 (see FIG. 4) formed on the housing 11 when the driver 3 reaches the driving position, thereby restricting the further rotation of the spring holding drum 73 in the drawing-out direction.

The driver guide parts 747 are arranged side by side on a central portion of the body 731 in the rotation axis A2 direction to be spaced apart from each other in the left-right direction. The driver guide part 747 is configured to hold the driver 3 in a stable attitude in the up-down direction when the driver 3 is placed in the initial position. Therefore, the amount of protrusion of the driver guide part 747 is set to correspond to a distance between the outer circumferential surface of the body 731 and the driver 3 placed in the initial position (see FIG. 10).

The wire 79 is a metal flexible member which connects the spring holding drum 73 and the driver 3. As shown in FIGS. 1 and 7, in the present embodiment, one end portion of the wire 79 connected to the spring holding drum 73 is configured as the locking end part 792 to which a spherical body is swaged. Further, the other end portion of the wire 79 which is connected to the driver 3 is configured as the locking end part 794 to which a spherical body and a rectangular body are swaged.

As shown in FIG. 1, the spherical body of the locking end part 792 is fitted in a spherical hole (see FIG. 8) formed in the wire connection part 735 of the winding part 733. A portion of the wire contiguous to the spherical body of the locking end part 792 is held in a slot (see FIG. 8) which connects the spherical hole and the winding groove 734. This slot extends radially outward along the winding direction of the operation end part 715 and connects to the winding groove 734. With such a structure, the locking end part 792 is locked in the wire connection part 735. Further, as shown in FIGS. 2 and 5, the spherical body of the other locking end part 794 is fitted in a spherical hole formed in the wire connection part 37 of the locking arm 35. The rectangular body of the locking end part 794 is arranged behind the spherical body with a wall part of the wire connection part 37 therebetween, and a portion of the wire between the spherical body and the rectangular body is engaged in a slot extending through the wall part in the front-rear direction. With such a structure, the locking end part 794 is locked to the driver 3.

It is noted that, as shown in FIG. 5, the distance between the winding part 733 and a center line of the spring holding drum 73 in the rotation axis A2 direction is set to be equal to the distance between the wire connection part 37 and a center line (the longitudinal axis of the driver 3) of the driver 3 in the left-right direction.

The first and second support members 75, 77 are configured to support the spring holding drum 73 for holding the return spring 71, so as to be rotatable with respect to the housing 11, and to guide rotation of the spring holding drum 73. More specifically, the first and second support members 75, 77 are fixed to the return mechanism housing part 110 of the housing 11, and rotatably support the spring holding drum 73 from the left and right such that the rotation axis A2 extends in the left-right direction. It is noted that, the spring holding drum 73 is disposed such that the center line of the spring holding drum 73 in the rotation axis A2 direction coincides with the working axis L. With such a structure, the flange-like winding parts 733 are disposed symmetrically on the left and right sides of the working axis L of the driver 3.

In the present embodiment, the first and second support members 75, 77 have generally the same symmetrical shape, but differ in that only the first support member 75 is configured to fix the fixed end part 713 of the return spring 71. The first and second support members 75, 77 are now explained.

As shown in FIG. 7, the first support member 75 includes the rotation support part 751, a spring fixing part 757, a body fixing part 752 and a wire guide part 755.

The rotation support part 751 is configured to rotatably support the left rotation guide part 741 of the spring holding drum 73. As shown in FIGS. 2 and 7, the rotation support part 751 has a bottomed circular cylindrical shape and has an inner diameter approximately equal to the outer diameter of the rotation guide part 741 of the spring holding drum 73. The depth (the distance between the opening and the bottom) of the rotation support part 751 is approximately equal to the amount of protrusion (the length in the rotation axis A2 direction) of the rotation guide part 741 from the winding part 733. The rotation support part 751 is fitted onto the left rotation guide part 741 from the left. Thus, the coil housing space 732 is closed from the left side by the rotation support part 751. As described above, the outer circumferential surface of the rotation guide part 741 includes the curved surface parts 742 and the flat surface parts 743. The rotation guide part 741 can rotate while the curved surface parts 742 slide in contact with the inner circumferential surface of the rotation support part 751. Further, grease is filled as a lubricant in a clearance between the inner circumferential surface of the rotation support part 751 and the flat surface parts 743.

The spring fixing part 757 is configured to fix the fixed end part 713 of the return spring 71 held by the spring holding drum 73. As shown in FIGS. 3 and 7, in the present embodiment, the spring fixing part 757 are formed as two protruding pieces which protrude to the right from a central portion of a circular bottom (right face) of the bottomed circular cylindrical rotation support part 751 and which are opposed to each other across a groove extending in the up-down direction. The spring fixing part 757 fixes the fixed end part 713 to the first support member 75 by holding the fixed end part 713 in this groove.

The body fixing part 752 is a portion that is configured to be fixed to the housing 11. As shown in FIGS. 3, 6 and 7, in the present embodiment, the body fixing part 752 has a circular cylindrical shape extending in the front-rear direction and is disposed on an outer face (left face) of the rotation support part 751. The body fixing part 752 has a threaded hole 753 inside. When the body fixing part 752 is engaged with the first fixing part 111 of the return mechanism housing part 110, the threaded hole 753 of the body fixing part 752 and the threaded hole 112 of the first fixing part 111 are coaxially connected to communicate with each other in the front-rear direction. The first support member 75 is fixed to the first fixing part 111 with the screw 759 which is threadably engaged with the threaded hole 753 and the threaded hole 112 in order. Thus, the fixed end part 713, which is fixed to the first support member 75 by the spring fixing part 757, of the return spring 71 is fixed to the housing 11 via the first support member 75.

Figure 11:
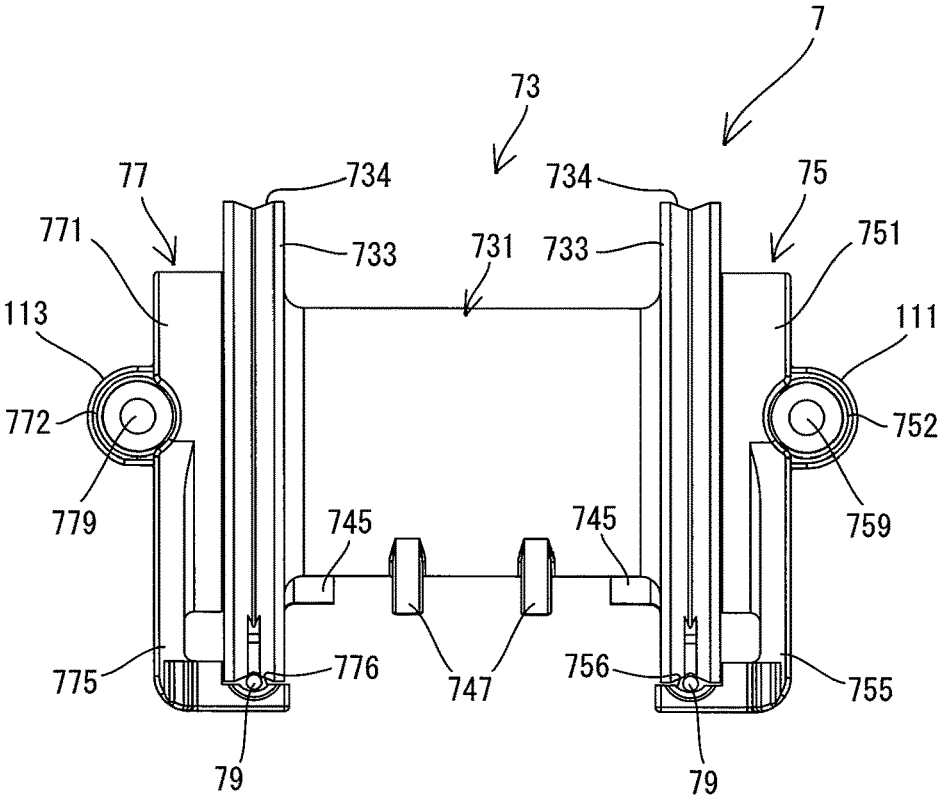
FIG. 11 is a front view of the return mechanism (wherein the driver is not shown).

The wire guide part 755 is configured to stably guide the wire 79 in the front-rear direction when the wire 79 is drawn out from the winding part 733 or wound on the winding part 733. As shown in FIG. 7, in the present embodiment, the wire guide part 755 is connected to a lower end of the rotation support part 751 and has a plate-like part extending in the front-rear direction. A wire guide groove 756 is formed on an upper surface of this plate-like part and extends in the front-rear direction. As shown in FIG. 11, the wire guide groove 756 is disposed below the left winding part 733 to face the winding groove 734 and serves to guide the wire 79 which is disposed between the wire guide groove 756 and the winding groove 734, in the front-rear direction.

As described above, the second support member 77 has almost the same structure as the first support member 75 except that the spring fixing part 757 is not provided, and therefore it is briefly described below. As shown in FIGS. 3 and 6, the second support member 77 includes the rotation support part 771, a body fixing part 772 and a wire guide part 775. Like the rotation support part 751, the rotation support part 771 has a bottomed circular cylindrical shape, but unlike the rotation support part 751, the rotation support part 771 does not have protruding parts on its bottom (left face). Like the body fixing part 752, the body fixing part 772 has a circular cylindrical shape having a threaded hole 773 inside. The second support member 77 is fixed to the second fixing part 113 with a screw 779 which is threadably engaged with the threaded hole 773 and a threaded hole 114 of the second fixing part 113 in order. Like the wire guide part 755, the wire guide part 775 is connected to a lower end of the rotation support part 771 and has a wire guide groove 776. As shown in FIG. 11, the wire guide groove 776 is disposed below the right winding part 733 to face the winding groove 734 and serves to guide the wire 79 disposed between the wire guide groove 776 and the winding groove 734, in the front-rear direction.

In the present embodiment, the first and second support members 75, 77 having the above-described structures realize two functions of guiding the rotation of the spring holding drum 73 and fixing the fixed end part 713 of the return spring 71 to the housing 11.

The initial states of the return mechanism 7 and the driver 3 are now explained. As shown in FIG. 1, in the return mechanism 7 in the initial state, the wires 79 are each wound on the winding part 733 almost one turn in the winding direction of the operation end part 715 (in the counterclockwise direction in FIG. 1). The wires 79 extend forward between the respective lower ends of the winding parts 733 and the wire guide parts 755, 775 (see FIG. 11) and are connected to the driver 3 at the locking end parts 794. Further, the return spring 71 is housed and held in the spring holding drum 73 in a state in which the fixed end part 713 is fixed to the housing 11 via the first support member 75 and a load in the winding direction is applied to the return spring 71. Therefore, the spring holding drum 73 is biased by an elastic force of the return spring 71 in a direction of rewinding the operation end part 715 (in the clockwise direction in FIG. 1), that is, in a direction of winding the wire 79 on the winding part 733 (hereinafter referred to as a winding direction).

In the initial state, the driver 3 is biased rearward via the wire 79 by the elastic force of the return spring 71 and held in the initial position in which the rear end 32 of the driver 3 abuts on the rear stopper 116. At this time, as shown in FIG. 3, the spring holding drum 73 is located above a rear end portion of the driver 3. Therefore, the rotation axis A2 of the spring holding drum 73 is located between the front and rear ends 31, 32 of the driver 3 in the working-axis-L direction. Further, the driver 3 is supported from below by the flywheel 53 between the front end 31 and the central portion of the driver 3 in the front-rear direction. Furthermore, the driver guide parts 747 of the spring holding drum 73 abut on the top of the rear end portion of the driver 3 and thereby restrict the rear end portion of the driver 3 from tilting upward. Thus, the driver 3 is held in a stable attitude in the up-down direction on the working axis L.

Operation of the nailer 1 is now described with reference to FIGS. 1, 4 and 5. As described above, in the nailer 1, the driving-out mechanism 5 is actuated when a user pulls the trigger 14 while pressing the contact arm (not shown) on the front end portion of the nose part 12 against the workpiece 100. More specifically, when the motor 51 is driven, the flywheel 53 is rotated and the pressure roller 57 is moved to the pressing position. Thus, the driver 3 placed in the initial position is held from above and below between the pressure roller 57 and the flywheel 53, and moved forward toward the driving position along the working axis L against the rearward biasing force.

The wires 79 connected to the locking arms 35 are pulled forward in interlock with the forward movement of the driver 3, so that the wires 79 are drawn out from the winding parts 733. Accordingly, the spring holding drum 73 is rotated in the drawing-out direction (in the counterclockwise direction in FIG. 1) around the rotation axis A2, against the elastic force of the return spring 71. As a result, the operation end part 715 locked in the locking groove 739 of the spring holding drum 73 is operated in the winding direction, so that a further elastic force is generated in the return spring 71. Further, the driver guide parts 747 guide the driver 3 to move forward in a stable attitude in the up-down direction as the spring holding drum 73 is rotated in the drawing-out direction.

As shown in FIG. 4, the driver 3 strikes the nail 9, and drives out the nail 9 from the injection port 123 to reach the driving position. Then, the front ends of the locking arms 35 of the driver 3 abut on the front stoppers 119 from the rear and the locking parts 745 of the spring holding drum 73 abut on the rotation stopper 117 from above, so that the movement of the driver 3 and the rotation of the spring holding drum 73 are stopped. As shown in FIG. 5, when the driver 3 is placed in the driving position, the wires 79 drawn out from the winding parts 733 symmetrically extend on the left and right sides of the working axis L and generally in parallel with the working axis L.

In this state, when the user stops pulling the trigger 14 or releases pressing of the contact arm against the workpiece 100, the operation of the driving-out mechanism 5 is stopped. Further, the return mechanism 7 operates to return the driver 3 to the initial position. More specifically, the spring holding drum 73 is rotated in the winding direction (in the clockwise direction in FIG. 4) by the elastic force of the return spring 71 which has been generated while the driver 3 has moved to the driving position. With the rotation of the spring holding drum 73, the wires 79 are wound on the winding parts 733, so that the driver 3 is pulled rearward by the wires 79 and returns to the initial position in which the rear end 32 of the driver 3 abuts on the rear stopper 116.

As described above, the nailer 1 of the present embodiment includes: the driver 3 which is held to be linearly movable between the initial position and the driving position along the working axis L; the driving-out mechanism 5 which is configured to move the driver 3 from the initial position to the driving position so as to cause the driver 3 to drive out the nail 9; and the return mechanism 7 which is configured to return the driver 3 from the driving position to the initial position. The return mechanism 7 is configured to return the driver 3 from the driving position to the initial position by utilizing the elastic force of the return spring 71, which is a torsion coil spring. The return spring 71 is subjected to torsional moment around the central axis A1 of the coil when the operation end part 715 is operated in the winding direction which crosses the central axis A1. In the return spring 71 having such a structure, collisions between adjacent portions of the wire, which may occur in a compression coil spring, can be prevented. Therefore, the durability of the return mechanism 7, which is configured to return the driver 3 to the initial position after the driver 3 drives out the nail 9, can be improved as compared with that using a compression coil spring. Further, there is no need to use a special component such as a multi-stranded twisted wire spring as a measure to improve the durability of the spring. Therefore, a cost increase can be suppressed.

Further, compared with a compression coil spring which expands and contracts in the direction of the central axis of the coil, the expansion/contraction amount of the return spring 71 in the central axis A1 direction is very small. Therefore, unlike a return mechanism with the compression coil spring, it is not necessary to provide a space margin for expansion and contraction of the spring and to provide a cylindrical guide part which is often used together with the compression coil spring. Therefore, the return mechanism 7 can be reduced in size and weight.

In the present embodiment, the return spring 71 is held by the spring holding drum 73, and the operation end part 715 of the return spring 71 is connected to the locking groove 739 of the spring holding drum 73. The spring holding drum 73 is supported to be rotatable relative to the housing 11 around the rotation axis A2 extending along (on) the central axis A1 of the return spring 71. The spring holding drum 73 is configured to operate the operation end part 715 when rotated in the drawing-out direction around the rotation axis A2 in interlock with the movement of the driver 3 to the driving position which is caused by the driving-out mechanism 5, and also configured to return the driver 3 to the initial position when rotated in the winding direction, which is opposite to the drawing-out direction, by the elastic force of the return spring 71. By thus interlocking the rotation of the spring holding drum 73, which holds the return spring 71 with the operation end part 715 connected thereto, with the movement of the driver 3, a function of generating an elastic force in the return spring 71 by the movement of the driver 3 to the driving position and returning the driver 3 to the initial position by the generated elastic force can be realized with a simple and compact structure.

In the present embodiment, the driver 3 and the spring holding drum 73 are connected by the wires 79, and the spring holding drum 73 has the winding parts 733 on which the wires 79 can be wound. The wires 79 are provided to rotate the spring holding drum 73 in the drawing-out direction when drawn out from the winding parts 733 by the movement of the driver 3 to the driving position, and to return the driver 3 to the initial position when wound on the winding parts 733 by the rotation of the spring holding drum 73 in the winding direction. Thus, by connecting the driver 3 and the spring holding drum 73 by the wires 79 which can be wound on the spring holding drum 73, the movement of the driver 3 and the rotation of the spring holding drum 73 can be interlocked with each other with a simple structure.

In the present embodiment, the pair of wires 79 are arranged across the working axis L of the driver 3. With such a structure, the driver 3 can be stably moved along the working axis L, both when the driver 3 is moved forward by the driving-out mechanism 5 to draw out the wires 79 from the spring holding drum 73 and when the driver 3 is moved rearward by the wires 79 as the wires 79 are wound on the spring holding drum 73. Particularly, in the present embodiment, the pair of right and left wires 79 are symmetrically arranged with respect to the working axis L extending in the front-rear direction, which can further stabilize the movement of the driver 3.

In the present embodiment, the length of the outer periphery of the winding part 733 (that is, the length of the winding groove 734) is set to be slightly longer than the travel of the driver 3 between the initial position and the driving position. The travel of the driver 3 between the initial position and the driving position corresponds to the length of the wire 79 which is to be wound on the spring holding drum 73. In the present embodiment, even when the driver 3 is returned up to the initial position, the wire 79 is wound on the winding part 733 without overlapping, so that deterioration of the wire 79 due to friction can be suppressed.

In the present embodiment, when the driver 3 is placed in the initial position, the rotation axis A2 of the spring holding drum 73 is located between the front end 31 and the rear end 32 of the driver 3 in the working axis-L-direction. Specifically, the spring holding drum 73 is arranged above the rear end portion of the driver 3, and thus overlaps with the driver 3 in the working-axis-L direction. With this arrangement, the overall length of the driver 3 and the spring holding drum 73 connected by the wire 79 can be shortened as much as possible in the working-axis-L direction of the driver 3.

The above-described embodiment is merely an example, and a driving tool according to the present invention is not limited to the structure of the nailer 1 of the above-described embodiment. For example, the following modifications or changes may be adopted. It is noted that, one or more of these modifications or changes may be applied in combination with the nailer 1 of the above-described embodiment or the claimed invention.

The driving tool may be a tool for driving a fastener other than the nail 9. For example, the driving tool may be embodied as a tacker or a staple gun which drives rivets, pins or staples. Further, the driving-out mechanism 5 is not limited to a structure including the motor 51 and the flywheel 53 like in the above-described embodiment, as long as the driving-out mechanism 5 is configured to move the driver 3 from the initial position to the driving position. For example, the driving-out mechanism 5 may be a mechanism that includes a motor and a plurality of gears, or a mechanism that is configured to be driven by compressed air.

As a member which can exert an elastic force for returning the driver 3 to the initial position, an elastic member other than the return spring 71 (torsion coil spring) may be employed. In this case, any elastic member may be employed which, like a torsion coil spring, is configured to generate an elastic force according to torsional moment acting around the axis of the elastic member. Further, the elastic member may be configured to return the driver 3 to the initial position by the elastic force which has been generated when torsional moment has been applied on the elastic member in interlock with a movement of the driver 3 to the driving position. For example, a torsion bar spring may be employed as such an elastic member. In this case, for example, one end of the torsion bar spring may be fixed to the housing 11 (or to an internal structure which does not move relative to the housing 11), while the other end may be connected to the driver 3 so that the torsion bar spring is twisted around the axis in interlock with a movement of the driver 3 to the driving position.

The shapes of the coil part 711, the fixed end part 713 and the operation end part 715 may be appropriately changed, as long as the return spring 71 is configured such that the fixed end part 713 is fixed and the operation end part 715 can be operated in a direction crossing the central axis A1 in interlock with a movement of the driver 3 to the driving position to thereby generate an elastic force in the return spring 71. Further, in the above-described embodiment, the operation end part 715 of the return spring 71 is operated in the direction of winding the coil, but the operation end part 715 may be operated in the direction of rewinding the coil. The fixed end part 713 may be directly or indirectly fixed to the housing 11 (or to an internal structure which does not move relative to the housing 11). Further, in the above-described embodiment, the return spring 71 in the initial state is held under a load in the winding direction in order to stably hold the driver 3 in the initial position, but the return spring 71 may be held under no load.

The return spring 71 does not need to be held by the spring holding drum 73. For example, the return spring 71 may be supported by a shaft inserted through the coil part 711 in the left-right direction, while the fixed end part 713 is fixed to the housing 11. Further, the operation end part 715 and the driver 3 may be connected to each other by one wire 79. In this case, when the driver 3 is moved to the driving position, the operation end part 715 is also operated in the direction crossing the central axis A1, so that an elastic force can be generated in the return spring 71. It is noted that the wire 79 may be guided in a proper direction, for example, by a pulley.

The spring holding drum 73 does not need to have the same structure as in the above-described embodiment, as long as the spring holding drum 73 is configured to hold the return spring 71 and to rotate around the rotation axis A2 extending along the central axis A1. For example, a spring holding member may be employed which includes a shaft part coaxially inserted through the coil part 711 of the return spring 71, and a connection part to which the operation end part 715 is connected so as to be operated in a direction crossing the central axis A1 (for example, in the direction of winding the coil) when the spring holding member is rotated in a prescribed direction.

The spring holding drum 73 does not need to be supported by the first and second support members 75, 77. For example, the spring holding drum 73 may be directly supported by a support structure provided in the housing 11. In this case, the fixed end part 713 may be directly fixed to the housing 11 (or to an internal structure which does not move relative to the housing 11). The first and second support members 75, 77 do not need to be two separately formed members and may be a single member configured to rotatably support the spring holding drum 73 and to fix the fixed end part 713 to the housing 11.

In order to shorten the overall length of the driver 3 and the return mechanism 7 in the working-axis-L direction as much as possible, like in the above-described embodiment, it may be preferable that the spring holding drum 73 is disposed such that the rotation axis A2 is located between the front end 31 and the rear end 32 of the driver 3 in the working-axis-L direction when the driver 3 is placed in the initial position. However, this does not exclude that the rotation axis A2 is located behind the rear end 32 of the driver 3 when the driver 3 is placed in the initial position.

Further, for example, the structure of connecting the spring holding drum 73 and the wires 79 and the structure of connecting the driver 3 and the wires 79 may be appropriately changed. An example of modification to the structure of connecting the driver 3 and the wires 79 is described below with reference to FIGS. 12 to 15.

Figure 12:
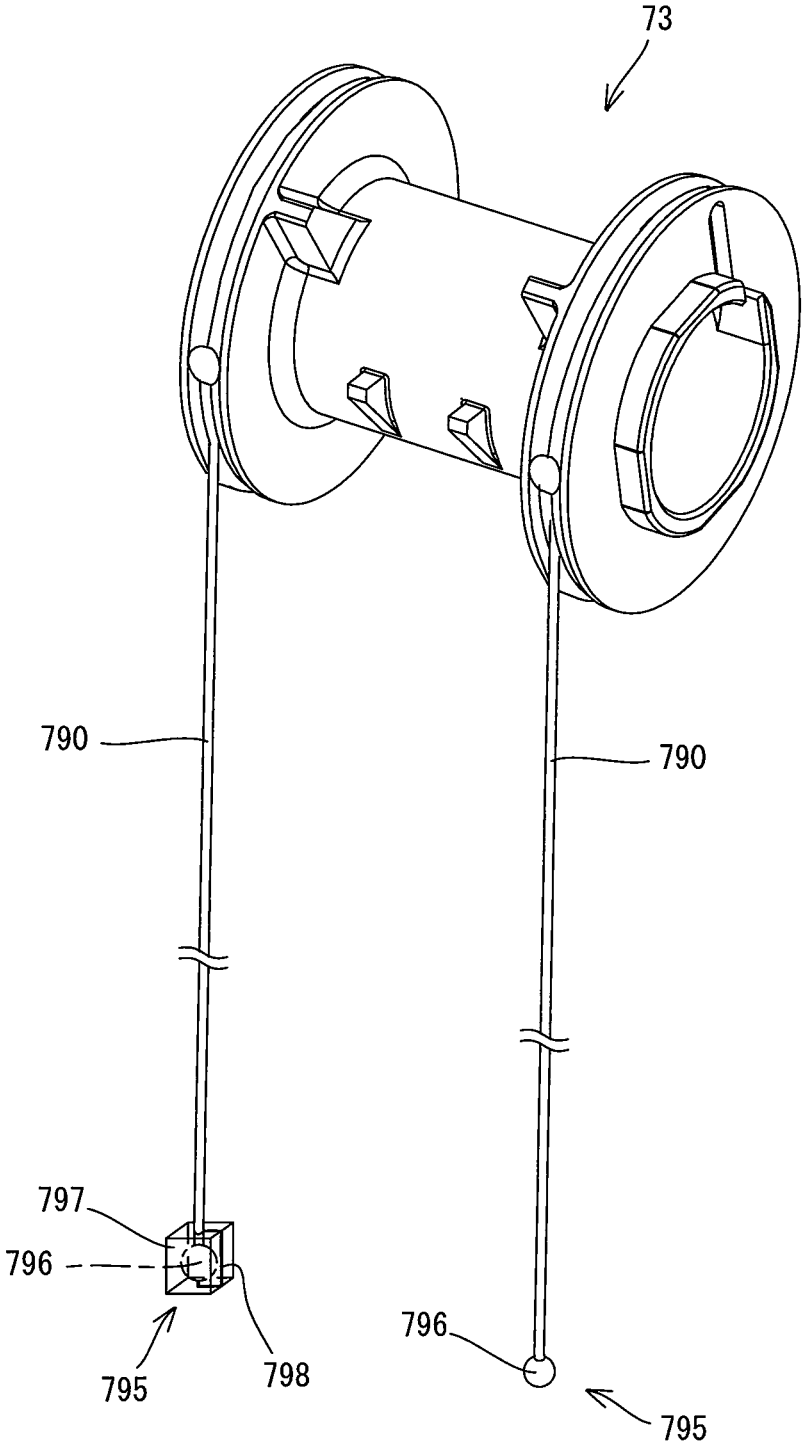
FIG. 12 is an explanatory drawing for illustrating wires according to a modification.

A wire 790 according to the present modification has the same locking end part 792 as the above-described embodiment (see FIG. 1) on the side connected to the spring holding drum 73. As shown in FIG. 12, however, the other end portion, a locking end part 795, differs from the locking end part 794 (see FIG. 7) of the above-described embodiment. Specifically, the locking end part 795 includes a metal spherical body 796 swaged on the end of the wire 790 and a cover 797 placed over the spherical body 796. It is noted that, in FIG. 12, the locking end part 795 of one of the wires 790 is shown in a state in which the spherical body 796 is not covered with the cover 797. In the present embodiment, the cover 797 is formed of rubber and has a generally cubic shape. The cover 797 has a spherical cavity formed in its center and a slot 798 which is cut from an outer surface of the cover 797 down to the cavity. In order to cover and hold the spherical body 796 with the cover 797, the spherical body 796 of the wire 790 is fitted in the cavity while the slot 798 is widened, and thereafter the slot 798 is closed by the restoring force of the rubber.

Figure 13:
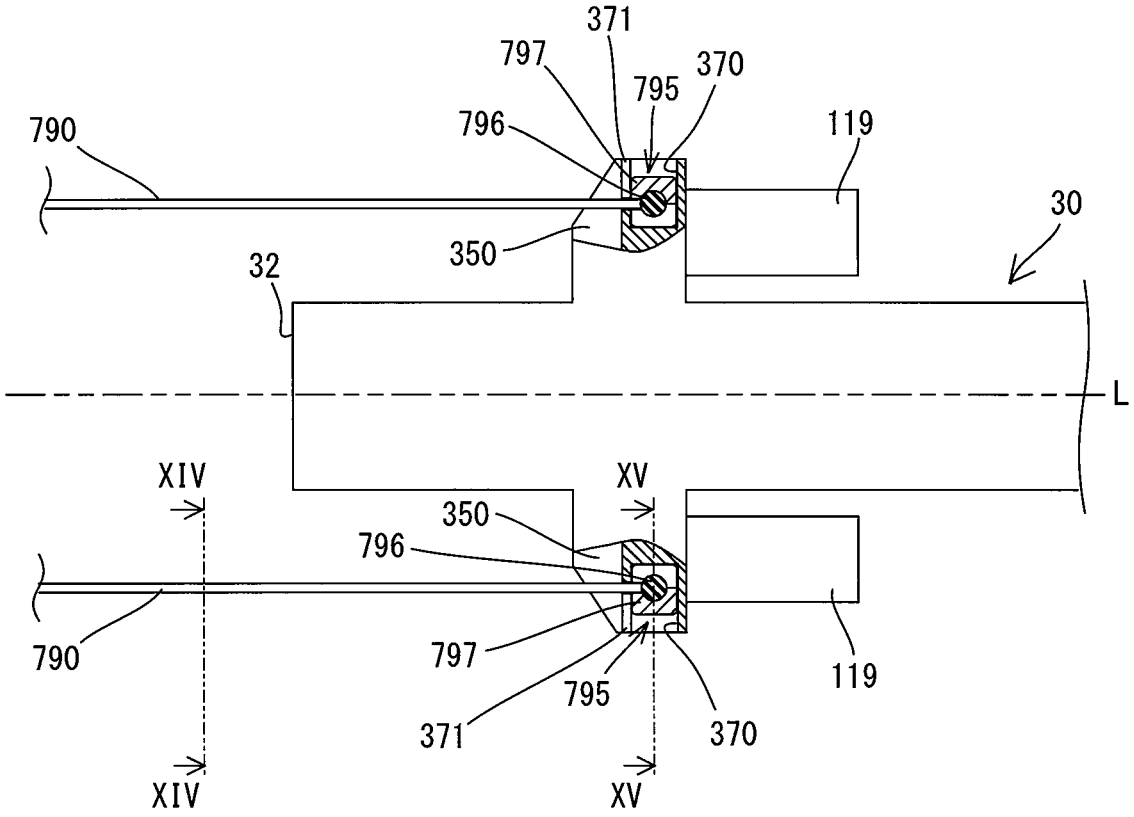
FIG. 13 is an explanatory drawing for illustrating a driver according to the modification.
Figure 14:
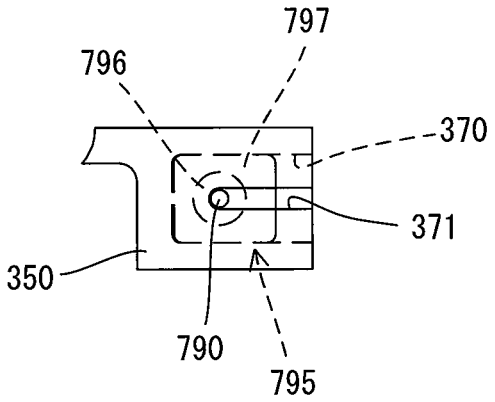
FIG. 14 is a sectional view taken along line XIV-XIV in FIG. 13.
Figure 15:
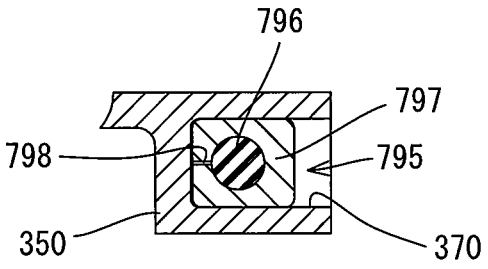
FIG. 15 is a sectional view taken along line XV-XV in FIG. 13.

As shown in FIGS. 13 to 15, a driver 30 according to the present modification includes locking arms 350 each having a wire connection part 370 which is different in structure from the wire connection part 37 (see FIG. 5) of the above-described embodiment. Specifically, the wire connection part 370 is formed as a rectangular recess recessed from a side surface of each of the locking arm parts 350 toward the working axis L. The height of the wire connection part 370 in the up-down direction is generally equal to the height of the cover 797 of the locking end part 795 of the wire 790, and the depth (the length in the left-right direction) of the wire connection part 370 is longer than that of the cover 797. Further, a rear end portion of the locking arm 350 (a portion on the rear side of the wire connection part 370) has a slot 371 cut from a side surface of the locking arm 350 toward the working axis L. The slot 371 communicates with the wire connection part 370.

The locking end part 795 (the cover 797) is fitted in the wire connection part 370 through an opening of the wire connection part 370 formed in the side surface of the locking arm 350, and the wire 790 extends rearward from the locking end part 795 through the slot 371. With such a structure, the locking end part 795 is engaged with the driver 30. By providing the locking end part 795 and the wire connection part 370 of the present modification, the wire 790 can be reliably connected to the driver 30 with a simple structure. Further, the rubber cover 797 can reduce impact to be imparted on the locking end part 795 when the driver 30 starts moving forward toward the driving position against the rearward biasing force of the return spring 71. Therefore, durability of the structure of connecting the wire 790 and the driver 30 can be improved.

In the embodiment and the modification which are described above, the movement of the driver 3, 30 and the rotation of the spring holding drum 73 are interlocked with each other by the wires 79, 790 which connect the driver 3, 30 and the spring holding drum 73 and which can be wound on the spring holding drum 73. In place of the wires 79, 790 which are metal flexible members, however, other flexible members may be employed. For example, a string-like member or a band-like member which is made of fibers having high tensile strength may be employed. Further, the wires 79, 790 or other flexible members do not need to be provided in a pair across the working axis L. Only one wire or a flexible member may be provided. In this case, it may be preferable that the wire 79, 790 or other flexible member is arranged to extend on the working axis L of the driver 3, 30 which passes the center of gravity of the driver 3, 30, in order to stabilize the movement of the driver 3, 30. The shape of the driver 3, 30 may be appropriately changed according to this change. Even the wires 79, 790 or other flexible members provided in a pair across the working axis L do not need to be symmetrically arranged with respect to the working axis L and may be appropriately arranged according to the position of the center of gravity of the driver 3, 30.

In order to suppress deterioration of the wires 79, 790 or other flexible members due to friction, it may be preferable that the length of the outer periphery of the winding part 733 (the length of the winding groove 734) is set to be longer than the travel of the driver 3, 30 between the initial position and the driving position. However, it is also acceptable that the length of the outer periphery of the winding part 733 (the length of the winding groove 734) is set to be equal to or shorter than the travel of the driver 3, 30.

Further, in view of the nature of the present invention and the above-described embodiment, the following features (aspects) can be provided. One or more of the following features may be employed in combination with the nailer 1 of the above-described embodiment or the claimed invention.

(Aspect 1)

The spring holding member may include a locking part protruding radially outward, and the driving tool may further include a rotation stopper configured to restrict rotation of the spring holding member by abutting on the locking part when the driver is moved to the driving position by the first moving mechanism.

(Aspect 2)

The spring holding member may include a driver guide part protruding radially outward, and the driver guide part may be configured to abut on the driver when the driver is placed in the initial position, and to guide a movement of the driver when the driver is moved from the initial position to the driving position.

(Aspect 3)

The support member may include a wire guide part arranged to face the winding part, and the wire guide part may be configured to guide the flexible member from and to the winding part when the flexible member is drawn out from or wound on the winding part.

Correspondences between the features of the above-described embodiment and the modification and the features of the invention are as follows. The nailer 1 is an example that corresponds to the "driving tool" according to the present invention. The nail 9 is an example that corresponds to the "fastener" according to the present invention. Each of the driver 3, 30 is an example that corresponds to the "driver" according to the present invention. The front end 31 and the rear end 32 of the driver 3, 30 are examples that correspond to the "tip end" and the "base end", respectively, according to the present invention. The driving-out mechanism 5 is an example that corresponds to the "first moving mechanism" according to the present invention. The return mechanism 7 is an example that corresponds to the "second moving mechanism" according to the present invention. The return spring 71, the fixed end part 713 and the operation end part 715 are examples that correspond to the "torsion coil spring", the "fixed end part" and the "operation end part", respectively, according to the present invention. The spring holding drum 73 and the winding part 733 are examples that correspond to the "spring holding member" and the "winding part", respectively, according to the present invention. Each of the first and second support members 75, 77 is an example that corresponds to the "support member" according to the present invention. Each of the wires 79, 790 is an example that corresponds to the "flexible member" according to the present invention.

DESCRIPTION OF NUMERALS

1: nailer, 10: body, 11: housing, 110: return mechanism housing part, 111: first fixing part, 112: threaded hole, 113: second fixing part, 114: threaded hole, 116: rear stopper, 117: rotation stopper, 119: front stopper, 12: nose part, 123: injection port, 13: handle, 14: trigger, 15: battery mounting part, 17: magazine, 19: battery, 3, 30: driver, 31: front end, 32: rear end, 35, 350: locking arm, 37, 370: wire connection part, 371: slot, 5: driving-out mechanism, 51: motor, 52: pulley, 53: flywheel, 54: pulley, 55: belt, 57: pressure roller, 7: return mechanism, 71: return spring, 711: coil part, 713: fixed end part, 715: operation end part, 73: spring holding drum, 731: body, 732: coil housing space, 733: winding part, 734: winding groove, 735: wire connection part, 739: locking groove, 741: rotation guide part, 742: curved surface part, 743: flat surface part, 744: cut part, 745: locking part, 747: driver guide part, 75: first support member, 751: rotation support part, 752: body fixing part, 753: threaded hole, 755: wire guide part, 756: wire guide groove, 757: spring fixing part, 759: screw, 77: second support member, 771: rotation support part, 772: body fixing part, 773: threaded hole, 775: wire guide part, 776: wire guide groove, 779: screw, 79, 790: wire, 792: locking end part, 794, 795: locking end part, 796: spherical body, 797: cover, 798: slot, 9: nail, 100: workpiece

The invention claimed is:

1. A driving tool configured to drive a fastener, the driving tool comprising:

a driver held to be linearly movable between an initial position and a driving position along a working axis;

a first moving mechanism configured to move the driver from the initial position to the driving position so as to cause the driver to drive the fastener; and a second moving mechanism configured to return the driver from the driving position to the initial position, wherein:

the second moving mechanism includes:

a torsion coil spring formed by spirally winding a wire around a central axis, the torsion coil spring having a fixed end part and an operation end part and being configured to return the driver to the initial position by an elastic force generated when the operation end part is operated in interlock with a movement of the driver to the driving position;

a spring holding member configured to hold the torsion coil spring and to rotate around a rotation axis extending along the central axis; and a flexible member connecting the driver and the spring holding member, the operation end part of the torsion coil spring is connected to the spring holding member, the spring holding member is configured to operate the operation end part when rotated in a first direction around the rotation axis in interlock with the movement of the driver to the driving position, and to be rotated in a second direction by the elastic force of the torsion coil spring, the second direction being opposite to the first direction, the spring holding member has a winding part, the winding part having an outer periphery on which the flexible member is to be wound, the flexible member is configured to rotate the spring holding member in the first direction when drawn out from the winding part by the movement of the driver to the driving position, and to return the driver to the initial position when wound on the winding part by the rotation of the spring holding member in the second direction, the rotation being caused by the elastic force, the flexible member is one of a metal wire, a string-like member made of fibers, and a band-like member made of fibers, and one end portion of the flexible member is connected to the winding part and the other end portion of the flexible member is connected to the driver via an impact-reducing material.

2. The driving tool as defined in claim 1, wherein:

the second moving mechanism further includes a support member configured to support the spring holding member so as to be rotatable relative to a tool body of the driving tool, the support member being configured to guide rotation of the spring holding member, and the fixed end part of the torsion coil spring is connected to the support member and thereby fixed to the tool body via the support member.

3. The driving tool as defined in claim 1, wherein the flexible member is arranged in a pair across the working axis.

4. The driving tool as defined in claim 3, wherein:

the driver has a tip end and a base end, the tip end being an end configured to abut on the fastener, the base end being another end on a side opposite to the tip end in an extending direction of the working axis, and the rotation axis of the spring holding member is disposed between the base end and the tip end when the driver is placed in the initial position.

5. The driving tool as defined in claim 1, wherein a length of the outer periphery of the winding part is set to be longer than a travel of the driver between the initial position and the driving position.

6. A driving tool configured to drive a fastener, the driving tool comprising:

a driver held to be linearly movable between an initial position and a driving position along a working axis;

a first moving mechanism configured to move the driver from the initial position to the driving position so as to cause the driver to drive the fastener; and a second moving mechanism configured to return the driver from the driving position to the initial position, wherein:

the second moving mechanism includes:

a torsion coil spring formed by spirally winding a wire around a central axis, the torsion coil spring having a fixed end part and an operation end part and being configured to return the driver to the initial position by an elastic force generated when the operation end part is operated in interlock with a movement of the driver to the driving position;

a spring holding member configured to hold the torsion coil spring and to rotate around a rotation axis extending along the central axis; and a flexible member connecting the driver and the spring holding member, the operation end part of the torsion coil spring is connected to the spring holding member, the spring holding member is configured to operate the operation end part when rotated in a first direction around the rotation axis in interlock with the movement of the driver to the driving position, and to be rotated in a second direction by the elastic force of the torsion coil spring, the second direction being opposite to the first direction, the spring holding member has a winding part, the winding part having an outer periphery on which the flexible member is to be wound, the flexible member is configured to rotate the spring holding member in the first direction when drawn out from the winding part by the movement of the driver to the driving position, and to return the driver to the initial position when wound on the winding part by the rotation of the spring holding member in the second direction, the rotation being caused by the elastic force, and wherein the driving tool further comprises:

a first stopper configured to stop the movement of the driver by abutting on the driver when the driver reaches the driving position; and a second stopper configured to stop the rotation of the spring holding member by abutting on a locking part provided on the spring holding member when the driver reaches the driving position.

7. The driving tool as defined in claim 6, wherein:

the second moving mechanism further includes a support member configured to support the spring holding member so as to be rotatable relative to a tool body of the driving tool, the support member being configured to guide rotation of the spring holding member, and the fixed end part of the torsion coil spring is connected to the support member and thereby fixed to the tool body via the support member.

8. The driving tool as defined in claim 6, wherein the flexible member is arranged in a pair across the working axis.

9. The driving tool as defined in claim 8, wherein:

the driver has a tip end and a base end, the tip end being an end configured to abut on the fastener, the base end being another end on a side opposite to the tip end in an extending direction of the working axis, and the rotation axis of the spring holding member is disposed between the base end and the tip end when the driver is placed in the initial position.

10. The driving tool as defined in claim 6, wherein a length of the outer periphery of the winding part is set to be longer than a travel of the driver between the initial position and the driving position.

11. A driving tool configured to drive a fastener, the driving tool comprising:

a driver held to be linearly movable between an initial position and a driving position along a working axis;

a first moving mechanism configured to move the driver from the initial position to the driving position so as to cause the driver to drive the fastener; and a second moving mechanism configured to return the driver from the driving position to the initial position, wherein:

the second moving mechanism includes:

a torsion coil spring formed by spirally winding a wire around a central axis, the torsion coil spring having a fixed end part and an operation end part and being configured to return the driver to the initial position by an elastic force generated when the operation end part is operated in interlock with a movement of the driver to the driving position; and a spring holding member configured to hold the torsion coil spring and to rotate around a rotation axis extending along the central axis, the operation end part of the torsion coil spring is connected to the spring holding member, the spring holding member is configured to operate the operation end part when rotated in a first direction around the rotation axis in interlock with the movement of the driver to the driving position, and to be rotated in a second direction by the elastic force of the torsion coil spring, the second direction being opposite to the first direction, the spring holding member includes a circular cylindrical body, and a coil part of the torsion coil spring is housed in the body of the spring holding member.

12. The driving tool as defined in claim 11, wherein:

the second moving mechanism further includes a support member configured to support the spring holding member so as to be rotatable relative to a tool body of the driving tool, the support member being configured to guide rotation of the spring holding member, and the fixed end part of the torsion coil spring is connected to the support member and thereby fixed to the tool body via the support member.

13. The driving tool as defined in claim 11, wherein:

the second moving mechanism further includes a flexible member connecting the driver and the spring holding member, the spring holding member has a winding part, the winding part having an outer periphery on which the flexible member is to be wound, the flexible member is configured to rotate the spring holding member in the first direction when drawn out from the winding part by the movement of the driver to the driving position, and the flexible member is also configured to return the driver to the initial position when wound on the winding part by the rotation of the spring holding member in the second direction, the rotation being caused by the elastic force.

14. The driving tool as defined in claim 11, wherein the flexible member is arranged in a pair across the working axis.

15. The driving tool as defined in claim 14, wherein:

the driver has a tip end and a base end, the tip end being an end configured to abut on the fastener, the base end being another end on a side opposite to the tip end in an extending direction of the working axis, and the rotation axis of the spring holding member is disposed between the base end and the tip end when the driver is placed in the initial position.

16. The driving tool as defined in claim 11, wherein a length of the outer periphery of the winding part is set to be longer than a travel of the driver between the initial position and the driving position.

* * * * *